US009736599B2

(12) United States Patent
Kellermann et al.

(10) Patent No.: US 9,736,599 B2
(45) Date of Patent: Aug. 15, 2017

(54) METHOD FOR EVALUATING A USEFUL SIGNAL AND AUDIO DEVICE

(71) Applicant: SIVANTOS PTE. LTD., Singapore (SG)

(72) Inventors: Walter Kellermann, Eckental (DE); Klaus Reindl, Dresden (DE); Yuanhang Zheng, Reutlingen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 14/873,396

(22) Filed: Oct. 2, 2015

(65) Prior Publication Data

US 2016/0029130 A1 Jan. 28, 2016

Related U.S. Application Data

(63) Continuation of application No. PCT/IB2014/059290, filed on Feb. 27, 2014.

(30) Foreign Application Priority Data

Apr. 2, 2013 (DE) ..... 10 2013 205 790

(51) Int. Cl.
*H04R 3/00* (2006.01)
*H04R 25/00* (2006.01)
(Continued)

(52) U.S. Cl.
CPC ..... *H04R 25/43* (2013.01); *H04R 25/407* (2013.01); *G10L 2021/02165* (2013.01); *G10L 2021/02168* (2013.01); *H04R 2460/01* (2013.01)

(58) Field of Classification Search
CPC ..... G10L 21/0208; G10L 2021/02165; G10L 2021/02168
(Continued)

(56) References Cited

U.S. PATENT DOCUMENTS 8,116,478 B2 * 2/2012 Kim ..... G10L 21/0208 381/122
8,238,575 B2 * 8/2012 Buck ..... G10L 25/78 381/71.11
(Continued)

FOREIGN PATENT DOCUMENTS

EP 2395506 B1 8/2012

OTHER PUBLICATIONS

Souden M et al., "On Optimal Frequency-Domain Multichannel Linear Filtering for Noise Reduction", IEEE Transactions on Audio, Speech and Language Processing, IEEE Service Center, New York, NY, USA, (Feb. 1, 2010), vol. 18, No. 2, doi:10.1109/TASL.2009.2025790, ISSN 1558-7916, p. 260-276, XP011329126 [A] 1-10 the whole document.
(Continued)

*Primary Examiner* — Sunita Joshi
(74) *Attorney, Agent, or Firm* — Laurence A. Greenberg; Werner H. Stemer; Ralph E. Locher

(57) ABSTRACT

A high-performance method evaluates a useful signal of an audio device, and in particular of an audio apparatus, for example for reducing interference. Accordingly, in the method at least two microphone signals are each obtained from a sound signal and a reference signal is obtained from the microphone signals, a portion of the microphone signals from a predetermined direction being blocked. The microphone signals are filtered by a filter such that an evaluation signal is obtained. To that end, a coherence value is determined from portions of the reference signal and a power density value is determined from the coherence value. The filter is parameterized on the basis of the power density value.

10 Claims, 1 Drawing Sheet

(51) Int. Cl.
*G10L 21/00* (2013.01)
*G10L 21/0216* (2013.01)

(58) Field of Classification Search
USPC ..... 381/317, 320, 71.11, 91, 94.1, 313, 60, 381/71.1, 92; 704/226, 271, 223
See application file for complete search history.

(56) References Cited

U.S. PATENT DOCUMENTS 8,392,184 B2 * 3/2013 Buck ..... G10L 21/0208 704/232
8,909,523 B2 12/2014 Kellermann et al.
2011/0307249 A1 * 12/2011 Kellermann ..... G10L 21/0208 704/226

OTHER PUBLICATIONS

Moonen M et al., "Robustness Analysis of Multichannel Wiener Filtering and Generalized Sidelobe Cancellation for Multimicrophone Noise Reduction in Hearing Aid Applications", IEEE Transactions on Speech and Audio Processing, IEEE Service Center, New York, NY, US, (Jul. 1, 2005), vol. 13, No. 4, doi:10.1109/TSA.2005.845821, ISSN 1063-6676, p. 487-503, XP011134931 [A] 1-10 the whole document.

Spriet A et al., "The impact of speech detection errors on the noise reduction performance of multi-channel Wiener filtering and Generalized Sidelobe Cancellation", Signal Processing, Elsevier Science Publishers B.V. Amsterdam, NL, vol. 85, No. 6, ISSN 0165-1684, (Jun. 1, 2005), p. 1073-1088, XP027670885 [A] 1-10 the whole document.

Y. Zheng et al., "BSS for improved interference estimation for blind speech signal extraction with two microphones", IEEE International Workshop on Computational Advances in Multi-Sensor Adaptive Processing (CAMSAP) Aruba, (2009), doi:10.1109/CAMSAP.2009.5413286, XP031628029.

I. McCowan et al., "Microphone array post-filter for diffuse noise field", IEEE Int. Conf. Acoustics, Speech, Signal Processing (ICAASP, (2002), doi:10.1109/ICASSP.2002.5743886, p. 905-908, XP032014943.

K. Reindl et al., "A stereophonic acoustic signal extraction scheme for noise and reverberant environments", Computer Speech and Language, (2012), doi:10.1016/j.csl.2012.07.011, XP028969073.

* cited by examiner

METHOD FOR EVALUATING A USEFUL SIGNAL AND AUDIO DEVICE

CROSS-REFERENCE TO RELATED APPLICATION

This is a continuation application, under 35 U.S.C. §120, of copending international application No. PCT/IB2014/059290, filed Feb. 27, 2014, which designated the United States; this application also claims the priority, under 35 U.S.C. §119, of German patent application No. DE 10 2013 205 790.3, filed Apr. 2, 2013; the prior applications are herewith incorporated by reference in their entirety.

BACKGROUND OF THE INVENTION

Field of the Invention

The present invention relates to a method for estimating a useful signal from a hearing apparatus by obtaining at least two microphone signals from a sound signal, obtaining a residual signal from the microphone signals, which residual signal has a portion of the microphone signals from a prescribable direction in a blocked state, and filtering the microphone signals using a filter, as a result of which an estimation is obtained for the useful signal. Furthermore, the present invention relates to a hearing apparatus having an appropriate microphone device, blocking device and a filter. In this case, a hearing apparatus is understood to mean any device that can be worn in or on the ear and produces a sound stimulus, particularly a hearing aid, a headset, headphones and the like.

Hearing aids are portable hearing apparatuses that are used to look after people with impaired hearing. In order to meet the numerous individual needs, different designs of hearing aids are provided, such as behind the ear hearing aids (BTE), hearing aid with an external receiver (RIC: receiver in the canal) and in the ear hearing aids (ITE), e.g. including concha hearing aids or canal hearing aids (ITE, CIC). The hearing aids listed by way of example are worn on the outer ear or in the auditory canal. Furthermore, there are also bone conduction hearing aids, implantable or vibrotactile hearing aids available on the market, however. These involve the damaged hearing being stimulated either mechanically or electrically.

Hearing aids basically have the essential components of an input transducer, an amplifier and an output transducer. The input transducer is normally a sound receiver, e.g. a microphone, and/or an electromagnetic receiver, e.g. an induction coil. The output transducer is generally in the form of an electroacoustic transducer, e.g. a miniature loudspeaker, or in the form of an electromechanical transducer, e.g. a bone conduction receiver. The amplifier is usually integrated in a signal processing unit. This basic design is shown in FIG. 1 using the example of a behind the ear hearing aid. A hearing aid housing 1 to be worn behind the ear incorporates one or more microphones 2 for picking up the sound from the environment. A signal processing unit 3, which is likewise integrated in the hearing aid housing 1, processes the microphone signals and amplifies them. The output signal from the signal processing unit 3 is transmitted to a loudspeaker or earpiece 4, which outputs an acoustic signal. The sound is transmitted to the eardrum of the device wearer, possibly via a sound tube that is fixed in the auditory canal with an ear mold. The power supply for the hearing aid and particularly that for the signal processing unit 3 are provided by a battery 5 that is likewise integrated in the hearing aid housing 1.

A particular challenge when using a hearing aid or another hearing apparatus is the use thereof in what is known as a cafeteria scenario. In this case, the wearer of the hearing aid or of the hearing apparatus talks to a dialog partner. The acoustic environment is additionally characterized by other speaking persons and by undefined background noise. In such a scenario, it is particularly difficult to extract the voice of the dialog partner from the total sound signal, i.e. to ascertain or estimate the actual useful signal. In this context, the noise signal or noise thus normally consists of background noise and/or disturbing voice portions or interference.

In order to implement multichannel noise reduction techniques, second-order statistical variables (in particular power spectral density PSD) of the noise components need to be estimated. Typically, these components are estimated during the target voice pauses. So that reliable estimations are performed only during the target voice pauses, the noise components need to be sufficiently steady over time, so that the estimation obtained is valid even when the target speaker is active again after a certain pause. In reality, the noise signals are not always steady, however. Therefore, effective multichannel noise reduction techniques are limited in their application, since they can barely be carried out in scenarios with non-steady signals (e.g. interference similar to voice).

The estimation of noise statistical variables for multichannel noise reduction techniques is typically based on what is known as target voice activity detection (VAD). This means that estimation of the entire noise PSD matrix is possible only in periods in which the target speaker is inactive. If the noise PSD matrix can be estimated only during the target voice pauses, it is important for the PSD of the noise components not to change greatly over time, i.e. the noise signals must be sufficiently steady (over time). The greatest disadvantage of this strategy is therefore that, for signals that (over time) are very unsteady (e.g. interference similar to voice), the estimations of the noise PSD matrix, which are able to be obtained only during the target voice pauses, are not reliable, since it cannot be assumed that the estimation obtained during a voice pause is still valid even after the target speaker has already been active again for a long time

SUMMARY OF THE INVENTION

Therefore, the object of the present invention is to provide a method for estimating a useful signal from a hearing apparatus that can also be used for signals that are non-steady over time, such as for voice. Furthermore, the aim is to provide a corresponding hearing apparatus.

The invention achieves this object by a method for estimating a useful signal from a hearing apparatus. The method includes:

a) obtaining at least two microphone signals from a respective sound signal, wherein the microphone signals form a microphone signal vector;
b) obtaining a reference signal vector from the microphone signal vector, which reference signal vector has a portion of the microphone signals from a prescribable direction in a blocked state;
c) filtering the microphone signal vector using a filter, as a result of which an estimation signal is obtained for the useful signal;
d) ascertaining a coherence variable from the reference signal vector and the microphone signal vector;

e) ascertaining a power density variable from the coherence variable; and f) parameterizing the filter on the basis of the power density variable.

Furthermore, the invention provides a hearing apparatus having a microphone device for obtaining at least two microphone signals from a respective sound signal, wherein the microphone signals form a microphone signal vector. A blocking device is provided for obtaining a reference signal vector from the microphone signal vector, which reference signal vector has a portion of the microphone signals from a prescribable direction in a blocked state. A filter is provided for filtering the microphone signal vector, as a result of which an estimation signal is obtained for the useful signal. A computation device ascertains a coherence variable from the reference signal vector and the microphone signal vector and ascertains a power density variable from the coherence variable and also for parameterizing the filter on the basis of the power density variable.

The reference signal vector may also be one-dimensional, i.e. consist of a single reference signal. Normally, it will consist of a plurality of reference signals, however.

Advantageously, the reference signal vector, i.e. portions of the residual signal, is thus used to obtain a coherence variable and particularly a coherence matrix, from which a power density variable, and particularly a power density matrix, for the residual signal (i.e. the noise portions) can be ascertained. This power density variable is used to parameterize the filter, so that a specific useful signal source can be filtered out or estimated from the microphone signals or the microphone signal vector. The proposed concept can thus also be used to estimate power spectral densities of noise components for signals that are not steady over time (e.g. voice), so that multichannel noise reduction techniques can be applied or implemented in practically any scenarios.

Preferably, obtaining the reference signal vector involves the prescribable direction of the useful signal being estimated from the microphone signal vector. It is thus possible to mask the useful signal from the entire coverage area of the sound.

In particular, it is advantageous to obtain the reference signal vector by using a directional blind source separation algorithm. Such a blind source separation algorithm has been proven in noise suppression, and it is very powerful owing to source localization that is carried out in advance.

Obtaining the reference signal vector may involve a respective useful signal component of each microphone signal being aligned with one another and then subtracted from one another. As a result, the signal channels (one channel for a microphone or a microphone signal) can be effectively freed of target or useful signal components. In this case, it is particularly beneficial if the useful signal components are aligned with one another both in terms of delay and in terms of their spectra. Hence, the useful signal components can be removed from the signal channels almost without residue.

The power density variable and particularly the power density matrix of the (multichannel) residual signal vector can be ascertained by using not only the coherence variable but also the residual signal vector itself. Hence, control using the power density can be provided for the filter on the basis of the coherence variable and the reference signal vector.

The useful signal may be a voice signal, in particular. Hence, the method according to the invention or the hearing apparatus according to the invention can be used particularly for increasing speech intelligibility.

Furthermore, the reference signal vector can contain voice signal portions that are not part of the useful signal. By way of example, the reference signal vector contains voice portions from speakers who are different than the target speaker.

The method features outlined above can also be implemented in the devices of the hearing apparatus, which provides these devices with the respective functionality.

Other features which are considered as characteristic for the invention are set forth in the appended claims.

Although the invention is illustrated and described herein as embodied in a method for evaluating a useful signal and an audio device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The exemplary embodiments outlined in more detail below are preferred embodiments of the present invention.

Figure 1:
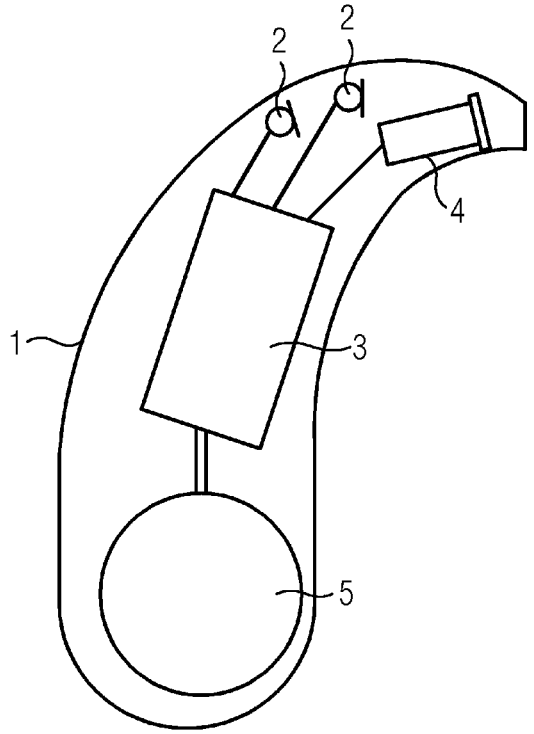
FIG 1 ( Prior art )
FIG. 1 is an illustration of a basic configuration of a hearing apparatus according to the prior art.
Figure 2:
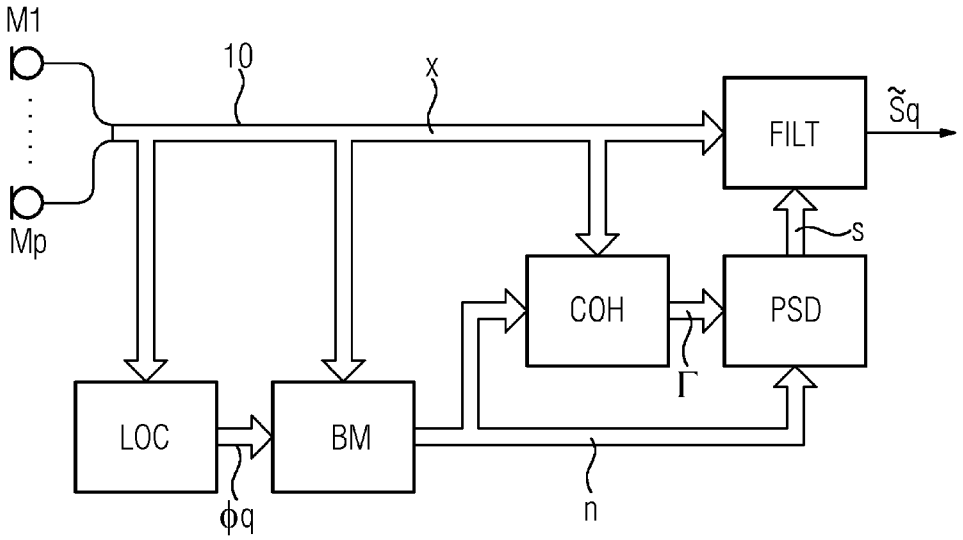
FIG. 2 is a block diagram of a system for estimating a useful signal according to the invention.

Referring now to the figures of the drawings in detail and first, particularly to FIG. 2 thereof, there is shown a method that can be implemented in a hearing aid as shown in FIG. 1 or in another hearing apparatus. Secondly, the blocks shown in FIG. 2 can represent corresponding devices of a hearing apparatus.

An exemplary hearing apparatus or an exemplary hearing aid contains a sensor or microphone arrangement having at least two sensors or two microphones M1, Mp. The text below refers always to microphones by way of representation.

Each microphone M1, Mp converts the respectively applied sound signal into a corresponding microphone signal. The sound signals are components of a sound field that represents the acoustic situation of a hearing aid wearer, for example. One such typical situation would be that of a "cafeteria scenario", in which the hearing aid wearer speaks to a dialog partner, one or more other persons are speaking in the background and there is other background noise. Alternatively, there may be a different acoustic situation that involves non-steady noise.

The microphone signals, which together form a microphone signal vector x, are each processed further in separate channels, i.e. one microphone signal is processed in each channel. FIG. 2 shows this multichannel processing by means of thick arrows. The microphone signal vector x is supplied to a source localization unit LOC (source localization) in the multichannel system 10. The source localization unit takes the microphone signal vector x and obtains position data $\phi q$ for a source Sq. In particular, the position information $\phi q$ from the useful signal source Sq is ascertained in three-dimensional space or simply just as an angle or an angle and distance. This position information $\phi q$ is used as coarse reference information for creating a blocking matrix BM. The blocking matrix BM is used to spatially mask from the microphone signals or the microphone signal vector x those portions that come from the spatial area of the useful signal source. By way of example, such a blocking matrix BM can be based on a directional blind source separation algorithm, as described in Y. Zheng, K. Reindl and W. Kellermann "BSS for Improved Interference Estimation for Blind Speech Signal Extraction with Two Microphones," in IEEE International Workshop on Computational Advances in Multi-Sensor Adaptive Processing (CAMSAP) Aruba, Dutch Antilles, December 2009. Alternatively, any other algorithms can be used for ascertaining the blocking matrix BM.

Hence, a multichannel reference signal or a reference signal vector n is obtained from the microphone signal vector x by applying the blocking matrix BM. If the signals are subtracted in the blocking matrix in pairs, for example, the number of signals of the multidimensional reference signal vector n can correspond to half the number of microphone signals or channels. An uneven number of microphone signals preferably prompts rounding up. The reference signal vector is thus normally a multidimensional vector containing a plurality of individual signals.

The reference signal vector n is supplied to a coherence estimation unit COH together with the microphone signal vector x that consists of the individual microphone signals. The coherence estimation unit estimates a coherence matrix $\Gamma$ from the two vectors n and x. The coherence matrix $\Gamma$ is supplied to a PSD estimation unit PSD. The PSD estimation unit estimates a multidimensional power density estimation variable S from the coherence matrix $\Gamma$ and the reference vector n, as described, by way of example, in I. McCowan and H. Bourlard, "Microphone Array Post-Filter for Diffuse Noise Field," in IEEE Int. conf. Acoustics, Speech, Signal Processing (ICASSP), 2002, pages 905-908 or in K. Reindl., Y. Zheng, A. Schwarz, S. Meier, R. Maas, A. Sehr, and W. Kellermann, "A Stereophonic Acoustic Signal Extraction Scheme for Noise and Reverberant Environments," Computer Speech and Language, 2012.

A multichannel filter FILT estimates filter parameters from the power density estimation variable S. The filter parameters are applied to the microphone signals or to the microphone signal vector x in the filter FILT, as a result of which the estimation signal q is obtained for the particular useful source or the useful signal.

Hence, it is primarily possible to achieve estimation of a non-steady second-order statistical variable relating to noise components by means of PSD by using the coherence of the relevant noise components. In this case, it is particularly possible to equate the target voice components initially in all the channels (delay compensation and spectral alignment), so that the available channels contain almost identical target voice components. This alignment can be accomplished by using a directional blind source separation algorithm of the type cited above. From the resultant signals, it is possible, as has been illustrated in detail above, to estimate the noise signal coherence matrix, which for its part is used to estimate the noise PSD matrix S. According to the invention, estimation of the useful signal thus requires no restrictions for the temporal signal characteristics. In contrast to known and typically used concepts, which can be used only for noise signals that are sufficiently steady (over time), the present invention uses the circumstance that the respective acoustic scenario is steady in space in order to estimate the noise PSD matrix. In this case, it can be assumed that the space domain for any scenarios is sufficiently steady, in contrast to the time domain. The reason for this is that the changes in the coherence function are primarily dependent on the spatial properties, i.e. on the geometric arrangement of the sources and objects in the acoustic scene. By contrast, the changes in the coherence function have only little dependency on the temporal properties of the signals.

In summary, this thus means that the method according to the invention or the hearing apparatus according to the invention is not limited to specific scenarios that relate to noise that is steady over time. Accordingly, the concept according to the invention makes it possible to use or implement powerful, multichannel noise reduction techniques for any scenarios in which noise suppression is necessary. A fundamental component of the invention is thus based on the insight of separating the estimation of the spatial coherence of noise signals from the estimation of the second-order temporal statistical variables (PSD of the noise components). In this case, the space/time coherence matrices can also be estimated continuously for scenarios with voice signals that are unsteady (over time).

In one specific example, the filter used can be a multichannel Wiener filter. In principle, however, it is also possible to use a signal-channel filter. Such filtering can be used for noise suppression in a binaural hearing aid, for example.

The PSD noise estimation together with the multichannel Wiener filter can be implemented in combination with a polyphase filter bank, as is typically used in hearing aids. The concept according to the invention can be realized on the basis of an SIR/SINR gain (signal to interference ratio/signal to interference and noise ratio). Furthermore, an ideal blind source separation scheme, for example, is assumed for the computation, i.e. the target voice components are approximately the same in all the available channels. Furthermore, in this specific case, it is possible to use ideal block-based voice activity detection (VAD) in order to estimate the noise coherence matrix.

In experiments, it has been possible to show that if need be a plurality of interference or voice signals can be markedly reduced (SIR at least 10 dB). Even if additional (diffuse) background chatter was present, an SINR of 8 dB was able to be achieved. In this case, processing artifacts (noise in the individual signals) were inaudible.

The invention claimed is:

1. A method for estimating a useful signal from a hearing apparatus, which comprises the steps of:

obtaining at least two microphone signals from a respective sound signal, wherein the microphone signals form a microphone signal vector;

obtaining a reference signal vector from the microphone signal vector, the reference signal vector having a portion of the microphone signals from a prescribable direction in a blocked state;

filtering the microphone signal vector using a filter, as a result of which an estimation signal is obtained as a useful signal;

ascertaining a coherence variable from the reference signal vector and the microphone signal vector;

ascertaining a power density variable from the coherence variable; and parameterizing the filter on a basis of the power density variable.

2. The method according to claim 1, wherein the step of obtaining the reference signal vector involves a prescribable direction of the useful signal being estimated from the microphone signal vector.

3. The method according to claim 2, which further comprises obtaining the reference signal vector by a directional blind source separation algorithm.

4. The method according to claim 1, wherein the step of obtaining the reference signal vector involves a respective useful signal component of each of the microphone signals being aligned with one another and then subtracted from one another.

5. The method according to claim 4, which further comprises aligning useful signal components with one another both in terms of delay and in terms of their spectra.

6. The method according to claim 1, wherein the coherence variable is a coherence matrix.

7. The method according to claim 1, wherein ascertaining the power density variable involves a use of the reference signal vector.

8. The method according to claim 1, wherein the useful signal is a voice signal.

9. The method according to claim 1, wherein the reference signal vector contains voice signal portions that are not part of the useful signal.

10. A hearing apparatus, comprising:

a microphone device for obtaining at least two microphone signals from a respective sound signal, the microphone signals forming a microphone signal vector;

a blocking device for obtaining a reference signal vector from the microphone signal vector, the reference signal vector having a portion of the microphone signals from a prescribable direction in a blocked state;

a filter for filtering the microphone signal vector, as a result of which an estimation signal is obtained as a useful signal; and a computation device for ascertaining a coherence variable from the reference signal vector and the microphone signal vector and for ascertaining a power density variable from the coherence variable and for parameterizing said filter on a basis of the power density variable.

* * * * *